US011926961B2

(12) United States Patent
Gscheider

(10) Patent No.: US 11,926,961 B2
(45) Date of Patent: Mar. 12, 2024

(54) PRESSURE SCREEN AND METHOD FOR DILUTION FOR A PRESSURE SCREEN

(71) Applicant: ANDRITZ (China) Ltd., Guangdong (CN)

(72) Inventor: Alexander Gscheider, Hohentauern (AT)

(73) Assignee: ANDRITZ (China) Ltd., Guangdong (CN)

( * ) Notice: Subject to any disclaimer, the term of this patent is extended or adjusted under 35 U.S.C. 154(b) by 0 days.

(21) Appl. No.: 17/733,034

(22) Filed: Apr. 29, 2022

(65) Prior Publication Data

US 2022/0349124 A1 Nov. 3, 2022

(30) Foreign Application Priority Data

Apr. 30, 2021 (CN) ..... 202110482017.5

(51) Int. Cl.
*D21D 5/06* (2006.01)

(52) U.S. Cl.
CPC ..... *D21D 5/06* (2013.01)

(58) Field of Classification Search
CPC ..... D21D 5/06; D21D 5/026; D21D 5/16
USPC ..... 209/303
See application file for complete search history.

(56) References Cited

U.S. PATENT DOCUMENTS 4,067,800 A * 1/1978 Young ..... B07B 1/20 209/273
4,267,035 A * 5/1981 Martin ..... D21D 5/026 210/213
4,634,521 A * 1/1987 Simola ..... B01D 29/908 210/512.3
5,078,878 A * 1/1992 Charette ..... D21D 5/026 210/414
5,221,437 A * 6/1993 Sieron ..... D21D 5/026 162/380
5,564,572 A * 10/1996 Iwashige ..... D21D 5/026 209/268
5,798,025 A * 8/1998 Iwashige ..... D21D 1/22 162/380

(Continued)

FOREIGN PATENT DOCUMENTS

CN 111364274 A * 7/2020 ..... D21D 5/02
CN 212077480 U * 12/2020

(Continued)

*Primary Examiner* — Gene O Crawford
*Assistant Examiner* — Muhammad Awais
(74) *Attorney, Agent, or Firm* — Alix, Yale & Ristas, LLP

(57) ABSTRACT

A method for dilution for a pressure screen comprising a rotor rotating inside a screen a distance to the screen, includes supplying feeding stock into a screening zone formed in the spacing between the rotor and the screen with some of the feeding stock passing through the screen into an accept area to become accept, and the remaining feeding stock discharged into a reject area as reject flow. The amount of the dilution water added into the reject flow is 0.8 to 3.5 times the amount of the reject flow by volume. Additionally, a pressure screen comprises a dilution water adding apparatus adapted to add dilution water directly into the reject area of the pressure screen, wherein the amount of the dilution water added into the reject flow is 0.8 to 3.5 times of the amount of the reject flow by volume.

4 Claims, 3 Drawing Sheets

(56) References Cited

U.S. PATENT DOCUMENTS 6,585,116 B1 * 7/2003 Doelle ..... B07B 13/14 209/283
6,679,384 B1 * 1/2004 Serres ..... D21D 5/026 209/385
6,702,120 B1 * 3/2004 Forslund ..... D21D 5/026 209/303
6,726,022 B2 * 4/2004 Wikstrom ..... D21D 5/026 210/414
8,869,989 B2 * 10/2014 Gallagher ..... D21D 5/026 210/415
2005/0126986 A1 * 6/2005 Aikawa ..... D21D 5/026 210/499
2006/0065589 A1 * 3/2006 Dal Maso ..... D21D 5/026 210/414
2006/0070924 A1 * 4/2006 Fredriksson ..... D21D 5/026 162/55
2006/0076278 A1 * 4/2006 Aikawa ..... D21D 5/026 162/55
2007/0114157 A1 * 5/2007 Fredriksson ..... D21D 5/026 209/305
2007/0215526 A1 * 9/2007 Aikawa ..... D21D 5/026 209/300
2007/0246181 A1 * 10/2007 Fredriksson ..... D21D 5/026 162/251
2010/0288681 A1 * 11/2010 Gallagher ..... D21D 5/026 209/303
2013/0001151 A1 * 1/2013 Hautala ..... D21D 5/026 210/408
2015/0345077 A1 * 12/2015 Bergdahl ..... D21F 1/0027 162/263
2017/0159239 A1 * 6/2017 Aikawa ..... B02C 23/18
2019/0048524 A1 * 2/2019 Hautala ..... D21D 5/026

FOREIGN PATENT DOCUMENTS

DE 102004039712 A1 * 3/2006 ..... D21D 5/02
DE 102011085691 A1 * 5/2012 ..... D21D 5/02
WO WO-9323609 A1 * 11/1993 ..... B01D 29/118
WO WO-03091497 A1 * 11/2003 ..... D21D 5/026
WO WO-2004046457 A1 * 6/2004 ..... D21D 5/026
WO WO-2011076660 A1 * 6/2011 ..... D21D 5/026
WO WO-2013083509 A1 * 6/2013 ..... D21D 5/026

* cited by examiner

PRESSURE SCREEN AND METHOD FOR DILUTION FOR A PRESSURE SCREEN

BACKGROUND

The inventive embodiments relate to a method for dilution for a pressure screen and a related pressure screen.

Pressure screens equipped with rotors and screen baskets or screen plates are commonly used to screen out impurities from fiber suspensions. In such a screening process, there is a certain thickening effect on the screening surface (perforated or slotted screen basket or screen plate) due to a certain filtration effect. The most common used screens are basket type screens operating under an outflow principle, which means inside of a perforated or slotted basket there is a rotor, which continuously cleans the screening surface at a certain distance.

Many different shapes and profiles of rotors are available on the market, but all of them in common focus on creating pressure and suction pulses towards the screening surface.

However, thickening happens over the height of the basket. Typically, as the height position within the device decreases (i.e., at positions closer to the reject outlet), the consistency or density of the material increases. Those skilled in the art understand that the reject has the highest consistency or density and the accept has the lowest consistency or density. This is actually an unwanted effect that limits the capacity of the device, and additionally increases the power required for operation, and thus overall energy consumption, because when the consistency increases, fewer fibers can pass the screen basket and friction increases the power required for operation.

In the state of art, there are measures to reduce this thickening by either adding dilution water into the reject area, or adding water in certain parts/areas directly into the screening zone.

Adding water into the screening zone usually involves complicated structures. Dilution water added to the reject area is usually in an amount within a range of 20-40% of the reject flow by volume. Usually, when the dilution water amount is above 40% of the reject flow, the motor load increases due to reject flow restriction in the screening zone caused by the fact that the dilution water is added into the reject room below the screening area (screen basket). In that case the dilution water only reduces the consistency in the reject room of the screen and not in the screening zone between rotor and basket. In other words, when dilution water flows towards the screening zone, due to the high consistency in the screening zone, it is hard for the dilution water to flow deeper into the screening zone to actually reduce the consistency. Thus, it is observed in the art that, when adding water in an amount of above 40% of the reject flow, the water will primarily flow via the "short cut" (path of least resistance) to the reject outlet of the screen instead of entering the screening zone and diluting the reject material in the screening area. This phenomenon usually leads to the screens overloading.

Another pressure screen is provided with reference to FIG. 2, which comprises a dilution water adding apparatus, which is adapted for adding dilution water directly into the screening area of the pressure screen, wherein the amount of the dilution water added into the screening zone can be 40-70% of the reject flow. In practice, if this amount is further increased, the dilution ends up essentially shooting directly through the screen basket into the accept area and is therefore not utilized well for reducing the consistency in the screening area. In addition, this kind of configuration is complicated and costly.

Hence, it would be useful to provide a continuous dilution as simple and cost effective as possible without negatively influencing the screen operation.

SUMMARY

In the disclosed embodiments, dilution water is added as widely used at the reject area; however, the amount of dilution water dosage differs and provides a significant advantage. As mentioned above, if dilution water reaches more than 40% of the reject flow, screen operation becomes difficult, power is increased and plugging and motor overloading is commonly observed. However, with the disclosed embodiments, it has been found that if the dilution water amount is even higher than the reject flow by volume, the thickening factor keeps decreasing and the motor load even comes down.

Therefore, to solve the above-mentioned technical problem, a method for dilution for a pressure screen is provide. The pressure screen comprises a rotor rotating inside a screen with a distance to the screen. Feeding stock is supplied into a screening zone formed by the spacing between the rotor and the screen. Some feeding stock goes through the screen into an accept area to become accept, and the remaining feeding stock is discharged into a reject area as reject flow. The amount of the dilution water added into the reject area is 0.8 to 3.5 times by volume, preferably 1.6 to 2.2 times of the amount of the reject flow, depending on the screening stage and the supply.

In this way, the reject rate is reduced, which means smaller and/or lesser latter stages will be used, thus leading to lower power consumption and reduction of cost of operation. Additionally, such a high volume of dilution water lowers the consistency in screening zone, thereby also reducing risk of plugging.

In another embodiment, a pressure screen is provided and comprises a dilution water adding apparatus configured for adding dilution water directly into the reject area of the pressure screen. The amount of the dilution water added into the reject flow is 0.8 to 3.5 times by volume, preferably 1.6 to 2.2 times of the amount of the reject flow.

It should be understood that the effect depends significantly on the rotor design itself. In a preferred embodiment, features for enhancing the distribution of the dilution water in the screening zone are provided on the rotor. It has been found that ribs or similar protruding structures provided on the front and back side of the foils on the rotor may enhance the distribution of the dilution water in the screening zone, and thus the rotor shows very stable operation even at a reject rate below 5%.

DETAILED DESCRIPTION

Figure 1:
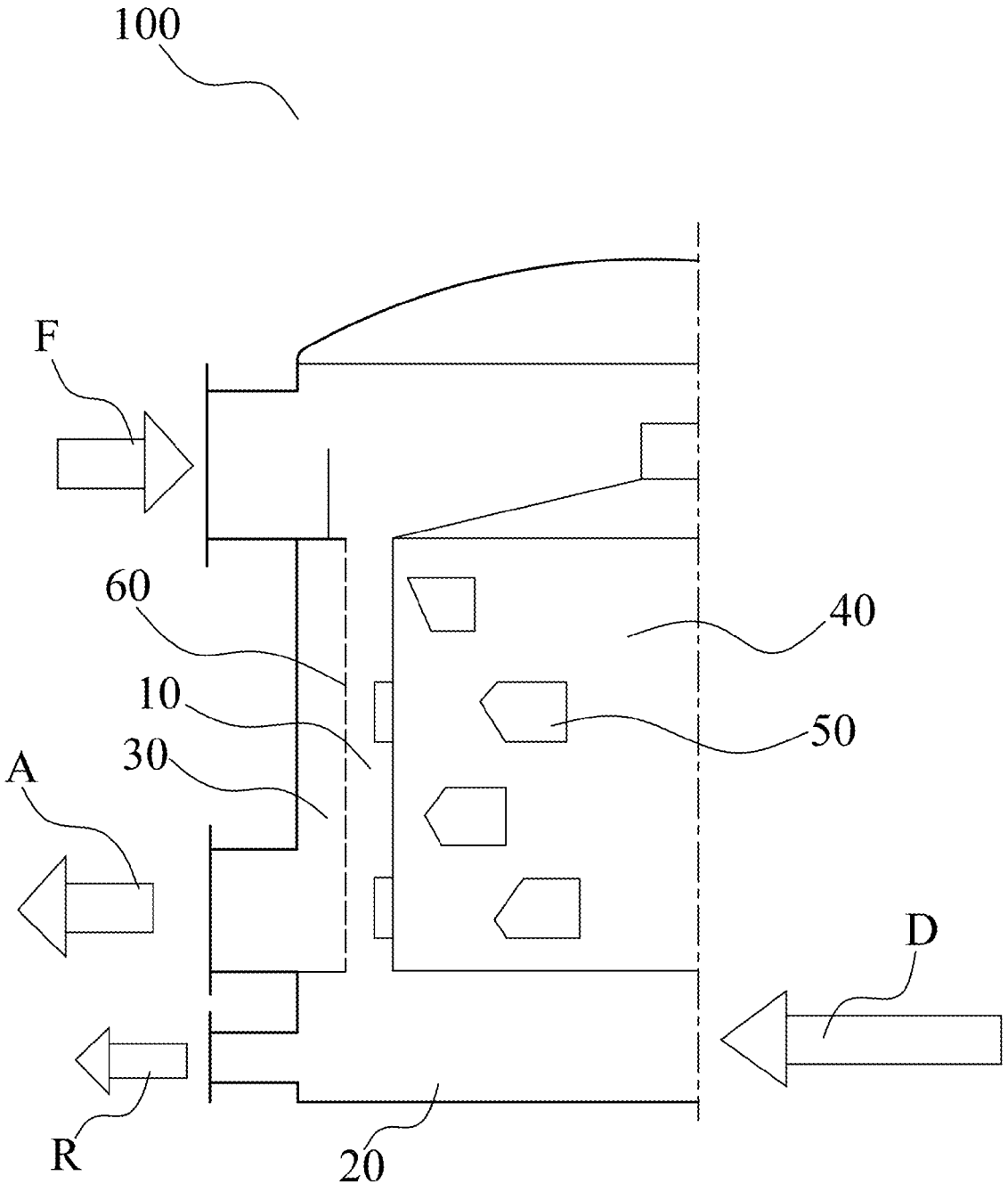
FIG. 1 schematically shows a section of a pressure screen with dilution water being added into its reject area.

As shown in in the section of the pressure screen 100 of FIG. 1, the dilution water D is still added into the reject area

20 of the pressure screen 100, similar to known methods and systems, however, the amount of the dilution water D added into the reject flow R is 0.8 to 3.5 times of the amount of the reject flow R via a dilution water adding apparatus adapted to do so (not shown).

As shown in FIG. 1, a rotor 40 rotates inside the screen 60 spaced from the screen 60 a distance. Feeding stock F is supplied into a screening zone 10 defined by the spacing between the rotor 40 and the screen 60. Some feeding stock F passes through the screen 60 into the accept area 30 and becomes accept A, and the remaining feeding stock F is discharged into a reject area 20 as reject flow R.

Figure 2:
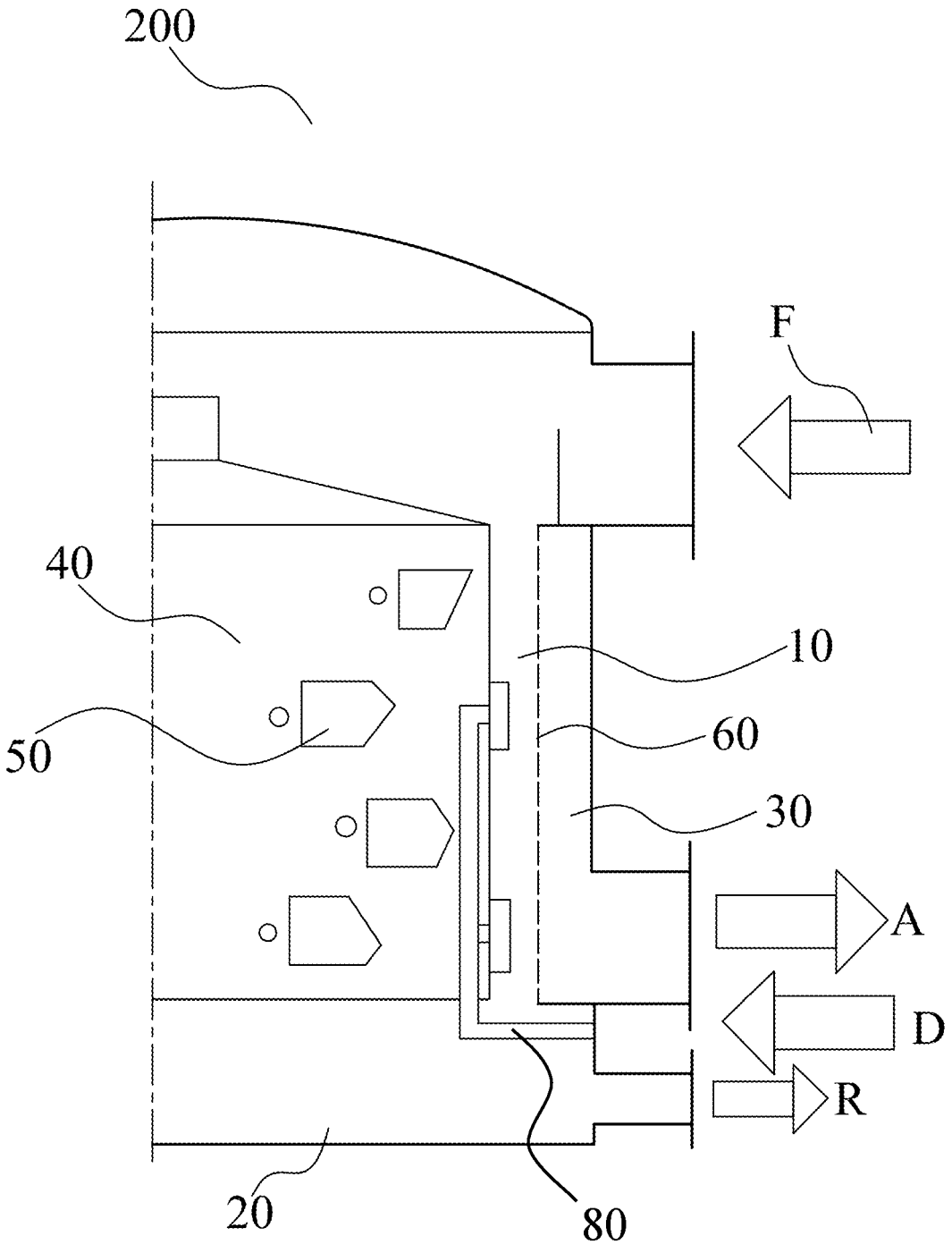
Fig. 2 (Prior Art)
FIG. 2 schematically shows a section of a pressure screen with dilution water being added into its screening zone via certain designed pipelines.

In this embodiment, pipelines like those shown as reference numeral 80 in prior art system of FIG. 2 for supplying dilution water D into the screening zone 10 are omitted. However, with the inventive embodiments that include the disclosed rotor, the same or even better screening effects are surprisingly obtained at lower energy consumption levels as compared with conventional structures that utilize conventional rotors which operate like the systems shown in FIG. 1 or FIG. 2.

Figure 3A:
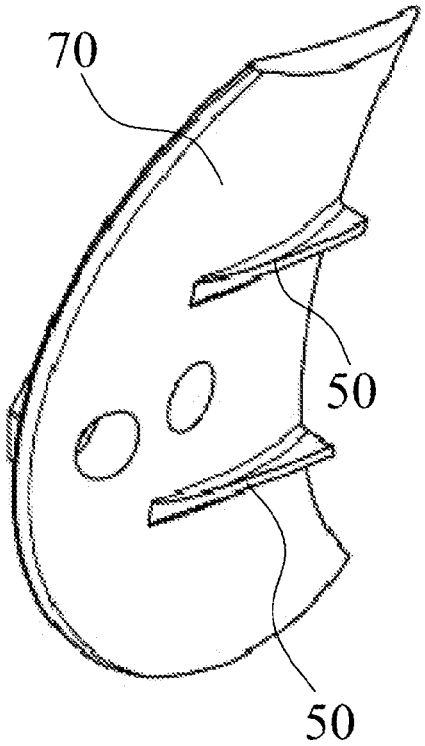
FIGS. 3A, 3B and 3C schematically show the front and back side of the foils for use within the disclosed embodiments and a rotor with foils.
Figure 3B:
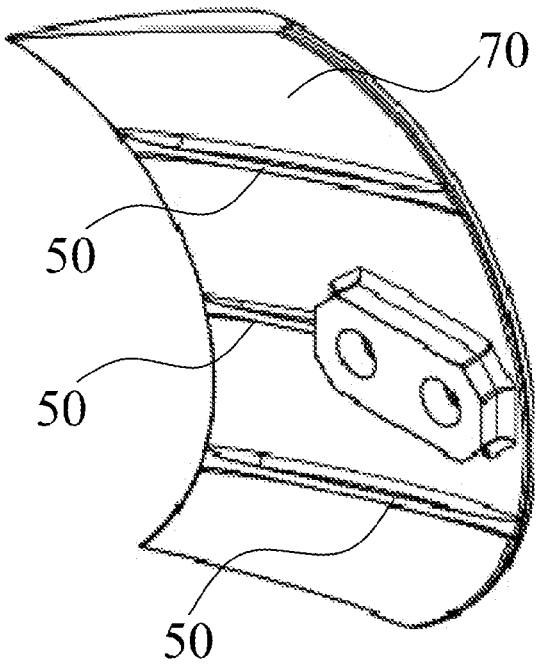
Figure 3C:
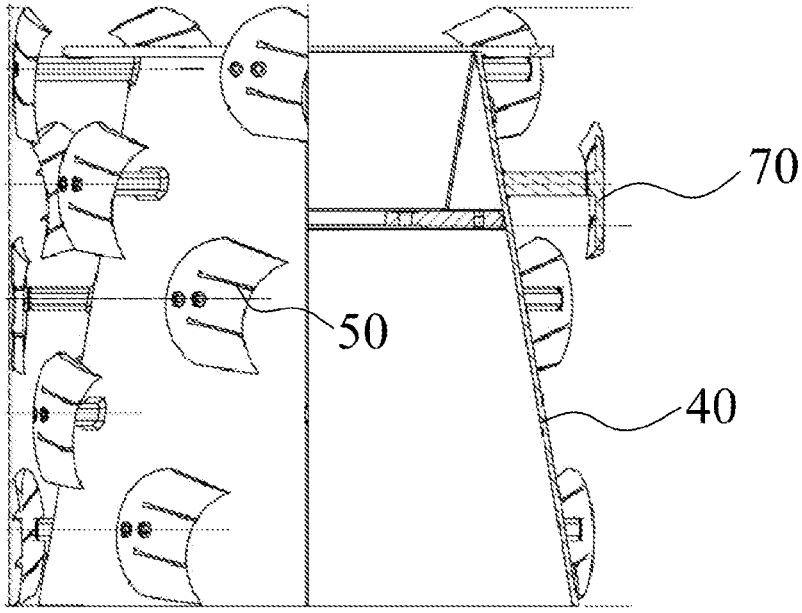

As can be seen from the exemplary systems shown in FIGS. 1 and 2, foils 70 can be provided on the rotor 40 to improve the flow condition in the screening zone 10. With reference to FIG. 3, in the disclosed system and method, ribs 50 or similar protruding structures are provided on the front and rears side of the foils 70 which enhance distribution of the dilution water D in the screening zone 10. The foils 70 with ribs 50 may be employed within a variety of pressure screen systems, including without limitation those shown generally in FIGS. 1 and 2, for improving flow conditions thereof.

The above discloses non-limiting preferable embodiments of this invention. Those skilled in the art can make adaptations and applications according to these teachings, and such adaptations and applications will be within the spirit and scope of this invention disclosed herein. Therefore, it will be understood that the specific embodiments do not define the spirit and scope of this invention, which is defined by the claims.

REFERENCE NUMBER LIST

10 Screening Zone
20 Reject area
30 Accept area
40 Rotor
50 Rib
60 Screen
70 Foil
100 Pressure screen
200 Pressure screen
F Feeding stock
A Accept
R Reject
D Dilution water

What is claimed is:

1. A method for dilution for a pressure screen having a rotor rotating inside a screen with spacing between the screen and rotor, the spacing defining a screening zone into which feeding stock is supplied, with a portion of feeding stock passing through the screen into an accept area and becoming accept, and the remaining feeding stock discharged into a reject area as reject flow, comprising adding dilution water directly into the reject area in an amount equal to 0.8 to 3.5 times of the amount of the reject flow, wherein the rotor comprises a plurality of foils having one or more ribs on a front and a rear side thereof to enhance the distribution of the dilution water in the screening zone.

2. The method according to claim 1, wherein the amount of the dilution water added into the reject area is 1.6 to 2.2 times the amount of the reject flow.

3. A pressure screen for separating a feeding stock into an accept portion and a reject portion, comprising one or more rotors inside a screen with spacing between the screen and rotor, the spacing defining a screening zone into which feeding stock is supplied; and a dilution water adding apparatus configured for adding dilution water directly into the reject area of the pressure screen, wherein at least one of the one or more rotors comprises a plurality of foils having one or more ribs on a front and a rear side thereof to enhance the distribution of the dilution water in the screening zone, and the amount of the dilution water added into the reject flow is 0.8 to 3.5 times the amount of the reject flow.

4. The pressure screen according to claim 3, wherein the amount of the dilution water added into the reject flow is 1.6 to 2.2 times the amount of the reject flow.

* * * * *